US008242915B2

(12) United States Patent
Yan et al.

(10) Patent No.: US 8,242,915 B2
(45) Date of Patent: Aug. 14, 2012

(54) CLOSURE ASSEMBLY

(75) Inventors: Zhirong Yan, Guangdon (CN); Chang Biao Chai, Shanghai (CN)

(73) Assignee: Access Business Group International LLC, Ada, MI (US)

( * ) Notice: Subject to any disclaimer, the term of this patent is extended or adjusted under 35 U.S.C. 154(b) by 767 days.

(21) Appl. No.: 11/986,695

(22) Filed: Nov. 26, 2007

(65) Prior Publication Data

US 2009/0134113 A1 May 28, 2009

(51) Int. Cl.
*G08B 13/14* (2006.01)

(52) U.S. Cl. ..... 340/572.8; 340/572.1; 340/572.7; 340/572.9; 215/50; 215/51; 215/228; 215/250; 215/251

(58) Field of Classification Search ..... 340/572.8, 340/572.1, 572.7, 572.9, 573.1, 539, 539.1, 340/539.11, 539.12; 215/228, 229, 230, 215/329, 235, 354, 50, 51, 250, 251
See application file for complete search history.

(56) References Cited

U.S. PATENT DOCUMENTS

| | | | | |
|---|---|---|---|---|
| 3,441,161 | A * | 4/1969 | Van Baarn | 215/235 |
| 4,210,251 | A * | 7/1980 | Grussen | 215/329 |
| 6,044,995 | A * | 4/2000 | Dai | 215/354 |
| 6,089,390 | A * | 7/2000 | Druitt et al. | 215/252 |
| 6,226,619 | B1 | 5/2001 | Halperin et al. | |
| 6,259,367 | B1 | 7/2001 | Klein | |
| 6,486,768 | B1 | 11/2002 | French et al. | |
| 6,554,187 | B2 | 4/2003 | Otto | |
| 6,879,876 | B2 | 4/2005 | O'Dougherty et al. | |
| 6,935,560 | B2 | 8/2005 | Andreasson et al. | |
| 6,965,866 | B2 | 11/2005 | Klein | |
| 6,975,205 | B1 | 12/2005 | French et al. | |
| 2001/0027401 | A1 | 10/2001 | Klein | |
| 2001/0037248 | A1 | 11/2001 | Klein | |
| 2002/0038267 | A1 | 3/2002 | Can et al. | |
| 2002/0056745 | A1 | 5/2002 | De La Fuente | |
| 2002/0093426 | A1 | 7/2002 | Jackson et al. | |
| 2002/0189667 | A1 | 12/2002 | O'Dougherty et al. | |
| 2003/0004608 | A1 | 1/2003 | O'Dougherty et al. | |
| 2003/0160698 | A1 | 8/2003 | Andreasson et al. | |
| 2003/0164401 | A1 | 9/2003 | Andreasson et al. | |
| 2003/0171984 | A1 | 9/2003 | Wodka et al. | |
| 2004/0059629 | A1 | 3/2004 | Luo et al. | |
| 2004/0064362 | A1 | 4/2004 | Rosenfeld | |
| 2004/0093265 | A1 | 5/2004 | Ramchandani et al. | |
| 2004/0093281 | A1 | 5/2004 | Silverstein et al. | |
| 2004/0129781 | A1 | 7/2004 | Kreiner et al. | |
| 2004/0172160 | A1 | 9/2004 | O'Dougherty et al. | |
| 2004/0195306 | A1 | 10/2004 | Carlson | |
| 2004/0254676 | A1 | 12/2004 | Blust et al. | |

(Continued)

*Primary Examiner* — George Bugg
*Assistant Examiner* — Sisay Yacob
(74) *Attorney, Agent, or Firm* — Brinks Hofer Gilson & Lione

(57) ABSTRACT

A closure assembly is provided that prevents tampering and counterfeiting of a container while at the same time protecting the contents stored therein from contaminants such as air and moisture. The closure assembly may include an upper closure portion securable to the container and a lower closure portion attached to the upper closure portion and securable to the container and adapted to evidence disengagement from the container. The lower closure portion may include a first section having a first cross section and a second section having a second cross section. The second cross section may be smaller than the first cross section, and may be adapted to evidence disengagement from the container if the lower closure portion is disengaged from the container.

18 Claims, 5 Drawing Sheets

U.S. PATENT DOCUMENTS

2005/0075900 A1 4/2005 Arguimbau
2005/0098621 A1 5/2005 De Sylva
2005/0108096 A1 5/2005 Burger et al.
2005/0110647 A1 5/2005 Ritson
2005/0127155 A1 6/2005 Claessens et al.
2005/0128087 A1 6/2005 Claessens et al.
2005/0131792 A1 6/2005 Rowe
2005/0149387 A1 7/2005 O'Shea et al.
2005/0149414 A1 7/2005 Schrodt et al.
2005/0242957 A1 11/2005 Lindsay et al.
2005/0280536 A1 12/2005 Hamilton et al.
2005/0289061 A1 12/2005 Kulakowski et al.
2006/0015404 A1 1/2006 Tran
2006/0015408 A1 1/2006 Brown
2006/0017569 A1 1/2006 Davies
2007/0296599 A1* 12/2007 Wang et al. ..... 340/572.8

* cited by examiner

CLOSURE ASSEMBLY

RELATED APPLICATIONS

The present patent document claims the benefit of the filing date under 35 U.S.C. §120 of U.S. Design patent application Ser. No. 29/286,923, filed May 22, 2007, which is hereby incorporated by reference.

FIELD OF THE INVENTION

The invention relates to an assembly for a container closure.

BACKGROUND OF THE INVENTION

There are a variety of common closures used to close a container holding a substance, such as medicine, food, powders, gels, and the like. For example, in the medicine industry, over-the-counter containers containing medicines often time employ a foil-like overlay atop the container opening to seal out contaminates. A closure is generally placed over the seal to allow the container to be re-closed after the foil-like overlay is removed or compromised. Common closures include screw-tight closures that screw onto the top of the container, snap-on closures that snap onto the top of the container, flip-top closure wherein a portion of the closure is attached to the container or some component of the container and is able to be flipped open to expose the inside of the container and later snapped shut. In addition, other closures are combinations of the aforementioned closures.

There are many problems with known closures. Besides some closures being difficult for those with arthritis or other hand ailments to open, closures can also be subject to counterfeiting. For example, closures are subject to counterfeiting because they can be removed from their intended container and replaced onto a different container. This can cause confusion in the marketplace if the closure itself is marked with some identifier of the original seller. Moving closures to other containers may also harm the purchasing public as the container they are purchasing may not contain the items indicated by the replaced closure. For example, a closure that was originally on a legitimate vitamin container may be moved to a container comprising illicit drugs.

Moreover, current closures may also fail to protect the quality of the goods inside the container. For example, once the seal is removed, the closure itself will often allow air, moisture, and other contaminants to reach the goods stored within the container even when close. Thus, product shelf-life may be compromised.

BRIEF SUMMARY OF THE INVENTION

A closure assembly for securing the contents of a container is disclosed. The closure assembly may include an upper closure portion securable to the container and a lower closure portion attached to the upper closure portion and securable to the container and adapted to be damaged if disengaged from the container. The lower closure portion may include a first section having a first cross section and a second section having a second cross section. The second cross section may be smaller than the first cross section, and may be adapted to evidence disengagement if the lower closure portion is disengaged from the container.

In another embodiment, a closure assembly for securing the contents of a container is disclosed. The closure assembly may include an upper closure portion securable to the container. The closure assembly may also include a lower closure portion attached to the upper closure portion and securable to the container. The lower closure may be adapted to be damaged if disengaged from the container, and may include a lower closure engagement section adapted to engage a first recess in the container.

In another embodiment, a closure assembly for securing the contents of a container is disclosed. The closure assembly may include an upper closure portion securable to the container. The upper closure portion may include an upper closure engagement section adapted to engage a first recess in the container, and a token compartment section adapted to secure a token to the upper closure portion. The token may include an RFID tag. The closure assembly may also include a lower closure portion attached to the upper closure portion and securable to the container. The lower closure portion may include a lower closure engagement section adapted to engage a second recess in the container, where the lower closure engagement section includes a first section having a first cross section and a second section having a second cross section, the second cross section smaller than the first cross section, where the second cross section is adapted to damage if the lower closure section is disengaged from the container. The lower closure portion may also include a tear away portion removably attached to the lower closure engagement section and the upper closure portion, where the upper closure portion may be disengaged from the container tear away portion without disengaging the lower closure portion if the tear away portion is removed.

BRIEF DESCRIPTION OF THE SEVERAL VIEWS OF THE DRAWINGS

The embodiments will be further described in connection with the attached drawing figures. Throughout the specification, like reference numerals and letters refer to like elements. It is intended that the drawings included as a part of this specification be illustrative of the embodiments and should in no way be considered as a limitation on the scope of the invention.

DETAILED DESCRIPTION OF PRESENTLY PREFERRED EMBODIMENTS

The embodiments provide an effective apparatus for closing a container. It is contemplated that which is disclosed herein can be used with containers holding solids, liquids and/or gases as well as containers having shapes different from that pictured herein.

A more detailed description of the embodiments will now be given with reference to FIGS. 1-5. The present invention is not limited to those embodiments illustrated; it specifically contemplates other embodiments not illustrated but intended to be included in the claims.

Figure 1:
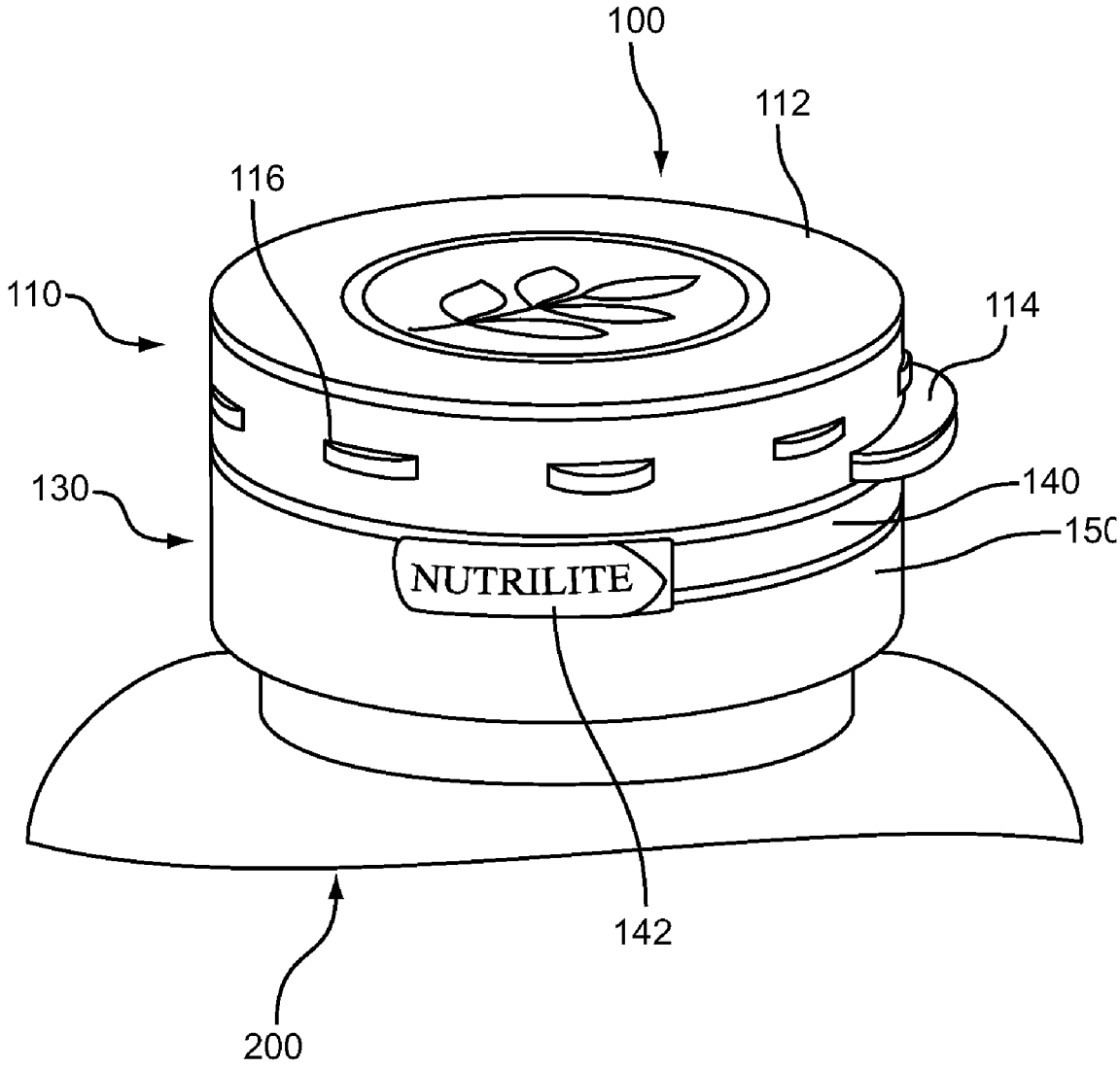
FIG. 1 is a diagram of a cap closure assembly and container in an engaged position.

Referring to FIG. 1, a cap closure assembly 100 and container 200 are shown. The cap closure assembly 100 may be configured to engage the neck of the container 200 (not shown in FIG. 1) in order to provide a tight connection between the two. The cap closure assembly 100 and container 200 may each be formed by an injection molding process. For example, the cap molding assembly 100 may be formed injection molding process using thermoplastic elastomers (TPEs), as known in the art. A separate process may be used to form the container 200. Or, the cap closure assembly 100 and container 200 may be formed using an integrated process. Other materials and/or process may also be used to form any portion of the cap closure assembly 100 and container 200. For example, TPEs may be used to form the cap closure assembly 100, and plastic elastomers (PEs) may be used to form the container 200. Additionally, or alternatively, a bi-injection molding process may be used to form the various parts of either the cap closure assembly 100 or container 200. It should be apparent to one of ordinary skill in the art that cap closure assembly 100 and container 200 may be formed in a virtually unlimited number of ways.

The cap closure assembly 100 may include an upper cap portion 110 and a lower cap portion 130. The upper cap portion 110 may engage the container 200 to provide a tight connection between the two. The upper cap portion 110 may engage the container 200 in such a manner as to secure the contents within the container 200. Additionally, the upper cap portion 110 may engage the container 200 in such a manner as to form a seal between the two that prevents the flow of fluids, such as liquids or gases, from entering or escaping the container 200.

The upper cap portion 110 may include an upper cap outer surface 112, an extended tab portion 114, and a dash strip 116. The upper cap outer surface 112 may be cylindrically shaped to cover the entire neck of the container 200. The upper cap outer portion may include a series of apertures which provide access to the dash strip 116. The dash strip 116 may extend through the apertures of the upper cap outer surface 112. The dash strip 116 may provide a distinctive look and feel that enables a purchaser of the goods packaged in the container 200 to quickly identify product origin. The extended tab portion 114 of the upper cap portion 110 may also provide a surface for assisting in the removal of the cap closure assembly 100 from the container 200.

The lower cap portion 130 of the cap closure assembly 100 may engage the container in such a manner as to provide a resistive force that prevents the cap closure assembly 100 from being easily removed from the container 200. In such a configuration, the lower cap portion 130 may provide removal and/or tamper resistance. The lower cap portion 130 may include a tear away portion 140 and a lower cap engagement portion 150. The tear away portion 140 may be attached to the upper cap portion 110 and the lower cap engagement portion 150. The tear away portion 140 may be attached to the upper cap portion 110 in a manner that allows the purchaser to partially separate the upper cap portion 110 from the lower cap portion 130. A section of the lower cap portion 130 may remain attached to the upper cap portion 110 to provide a pivot point for removal of the upper cap portion 110 in a flip top manner. Such a configuration ensures that the cap closure assembly 110 remains attached to the container 200 even when the contents of the container are accessible to the purchaser. In this way, for example, the cap closure assembly 110 may not be lost. At the same time, this arrangement may allow the purchaser to eliminate the additional resistant force needed to overcome the engagement of the lower cap engagement portion 150 from the container 200 when the purchaser attempts to access the contents of the container.

The tear away portion 140 may be attached to the lower cap portion 130 using any manner. Alternatively, the tear away portion 140 may extend across the entire circumference of the cap closure assembly 110 to allow for the complete removal of the upper cap portion 110 from the container 200.

The tear away portion 140 may be attached to the upper cap portion 110 in a perforated manner. Alternatively, the tear away portion 140 may be attached to the upper cap portion 110 using a thin cross section so that a small force is required to separate the two. Or, a combination of these approaches may be used. Other methods for attaching the upper cap portion 110 to the tear away portion 140 of the lower cap portion 130 may also be used.

The tear away portion 140 may include a tear away tab 142. The tear away tab 142 of the tear away portion 140 may provide a gripping surface for the purchaser to utilize when separating the tear away portion 140 from the upper cap portion 110. The tear away tab 142 may be formed in an elongated oval shape to provide a large griping surface. A large gripping surface may make removal of tear away portion 140 easier.

Figure 2:
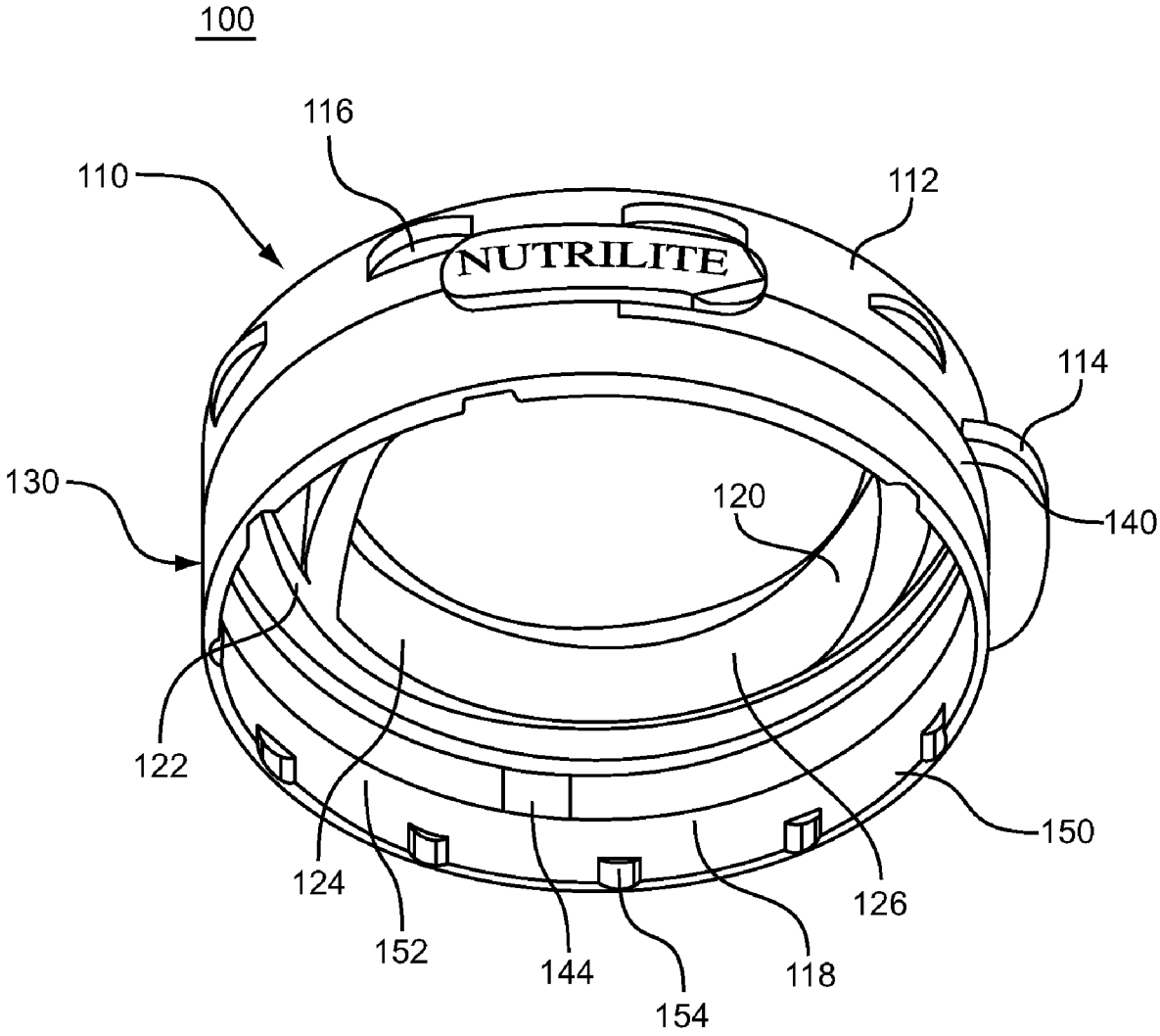
FIG. 2 is a diagram of an angled bottom view of a cap closure assembly.

Referring to FIG. 2, an angled bottom view of the cap closure assembly 100 is shown. The upper cap portion 110 may include a upper cap engagement section 118. The upper cap engagement section 118 may be a wedge shaped body that extends inwardly from the inner surface of the upper cap portion 110. Other shapes may also be used. The upper cap engagement section 118 may engage a corresponding portion of the container 200 (not shown).

The upper cap portion 110 may also include an upper cap sealing section 120 for providing a seal between the cap closure assembly 100 and the container 200. The upper cap sealing section 120 may be a cylindrical body attached to the top of the upper cap portion 110. The upper cap sealing section 120 may include an upper cap sealing section outer surface 122 that engages the neck of the container 200 to provide a seal for maintaining the state of the product enclosed in the container 200. The upper cap sealing section 120 may also include an upper cap sealing section inner surface 122 that includes one or more extended portions 126 for securing a token (not shown), as described in more in more detail below.

The lower cap portion 130 may include one or more apertures 144 that separate the tear away portion 140 from the remainder of the lower cap portion 130 (i.e. the fixed pivot point). Additionally, the lower cap engagement portion 150 of the lower cap portion 130 may include a lower cap container engagement section 152. The lower cap container engagement section 152 may be a wedge shaped body that extends inwardly from the inner surface of the lower cap engagement portion 150. Other shapes may also be used. When engaged, the lower cap container engagement section 152 may provide a resistant force that makes removal of the cap closure assembly 100 more difficult.

The lower cap engagement portion 150 may also include one or more weak gaps 154. The weak gaps 154 may be integrally attached to the lower cap engagement portion 150 such that the cross section of the lower cap engagement portion 150 is smaller at the weak gaps 154 than at the remainder of the lower gap engagement portion 150. The reduced cross section makes the weak gaps 154 more likely to be damaged if a force is applied to remove the cap closure assembly 100 from engagement with the container 200 without removing the tear away portion 140 to eliminate the additional resistant force provided by the lower cap engagement portion 150. The broken or damaged weak gaps 154 may provide a visual indication that the contents of the container 200 may have been compromised, and, in such a manner, evidence disengagement of the lower cap engagement portion 150 from the container 200. Similarly, the removal of the tear away portion 140 may also provide a visual indication that the contents of the container 200 may have been compromised. As a result, the lower cap engagement portion 150 may provide multiple tamper resistance features to ensure the integrity of the contents of the container 200. Other forms of evidencing the removal or tampering of the lower cap portion 150 from the container 200 may also be used. For example, the evidence of removal may be irreversible and/or not readily hidden or obscured.

Figure 3:
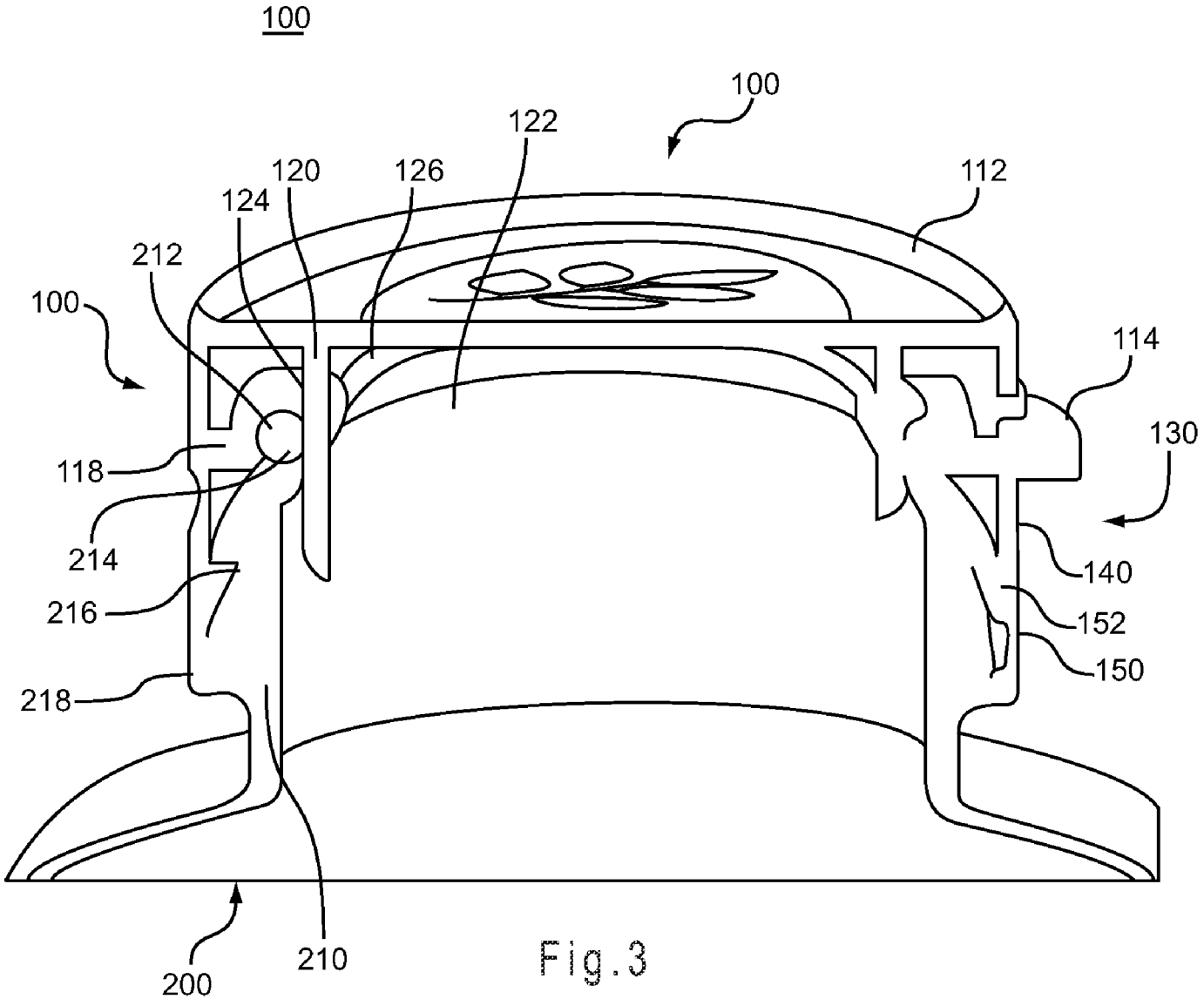
FIG. 3 is a diagram of a cross section of a cap closure assembly in an engaged position with a container.

Referring to FIG. 3, a cross section of the cap closure assembly 100 in an engaged position with the container 200 is shown. The container 200 may include a neck 210 for engaging the cap closure assembly 100. The neck 210 may include a first recess 212, a neck sealing portion 214, a second recess 216, and a lower lip 218. The first recess 212 may provide a recess for receiving the upper cap engagement portion 118 to secure the cap closure assembly 100 to the container 200. Similarly, the second recess 214 may provide a recess for receiving the lower cap engagement section 152 to further secure the cap closure assembly 100 to the container 200.

The amount of force required to disengage the upper cap engagement portion 118 from the first recess 212 may be same as the force required to disengage the lower cap engagement section 152 from the second recess 214. Alternatively, a greater amount of force may be required to disengage the lower cap engagement section 152 from the second recess 214 than that required to disengage the upper cap engagement portion 118 from the first recess 212. In such a configuration, the cap closure assembly may provide a very strong anti-tamper resistance (i.e. removal of the entire cap closure 100 may require a large force). At the same time, removal of the upper cap portion 110 is made easier by a bona fide purchaser of the goods once the additional resistance of caused by engagement of the lower cap portion 130 is eliminated by removal of the tear away portion 140.

The lower lip 218 may extend outwardly from the neck 210. The lower lip may be a rigid extrusion adapted to contact the bottom lower cap portion 130. As a result, the lower lip 218 may provide additional tamper resistance by blocking access to the bottom of the lower cap portion 130. For example, the hindrance caused by the lower lip 218 may make it difficult to pry the lower cap engagement section 152 from the second recess 214 without damaging or breaking the weak gaps 154.

The neck 210 may also include a neck sealing portion 214. The neck sealing portion 214 may be a cylindrical portion that inwardly extending portion designed to form a seal with the outer surface 122 of the upper cap sealing section 120. The outer surface of the 122 of the upper cap sealing section 120 may be a smooth, uniform surface. The diameter of the neck sealing portion 214 may be smaller than the outer diameter of the upper cap sealing section 120, so that engagement of the cap closure assembly 100 to the container 200 causes compression of the neck sealing portion 214, the outer surface 122 of the upper cap sealing section 120, or both. Such an arrangement may provide a tight fit between the neck sealing portion 214, the outer surface 122 of the upper cap sealing section 120, causing a seal to form. Other configurations may also be used to provide a seal between the neck sealing portion and the outer surface 122 of the upper cap sealing section 120.

The upper cap sealing section 120 may also include token engagement portion 126. The token engagement portion 126 may be a protrusion that extends inwardly from the inner surface 124 of the upper cap sealing section 120 to form a token compartment. The formed token compartment may be adapted to secure a token, described below. The token engagement portion 126 may be a wedge shaped portion that extends along the entire circumference of the inner surface 124 of the upper cap sealing section 120. Or, the token engagement portion 126 may include a plurality of protrusions that extend inwardly from the inner surface 124 of the upper cap sealing section 120. The token engagement portion 126 may also be separate from the upper cap sealing section 120. For example, an additional cylindrical body may be provided to secure a token to the cap closure assembly.

Figure 4:
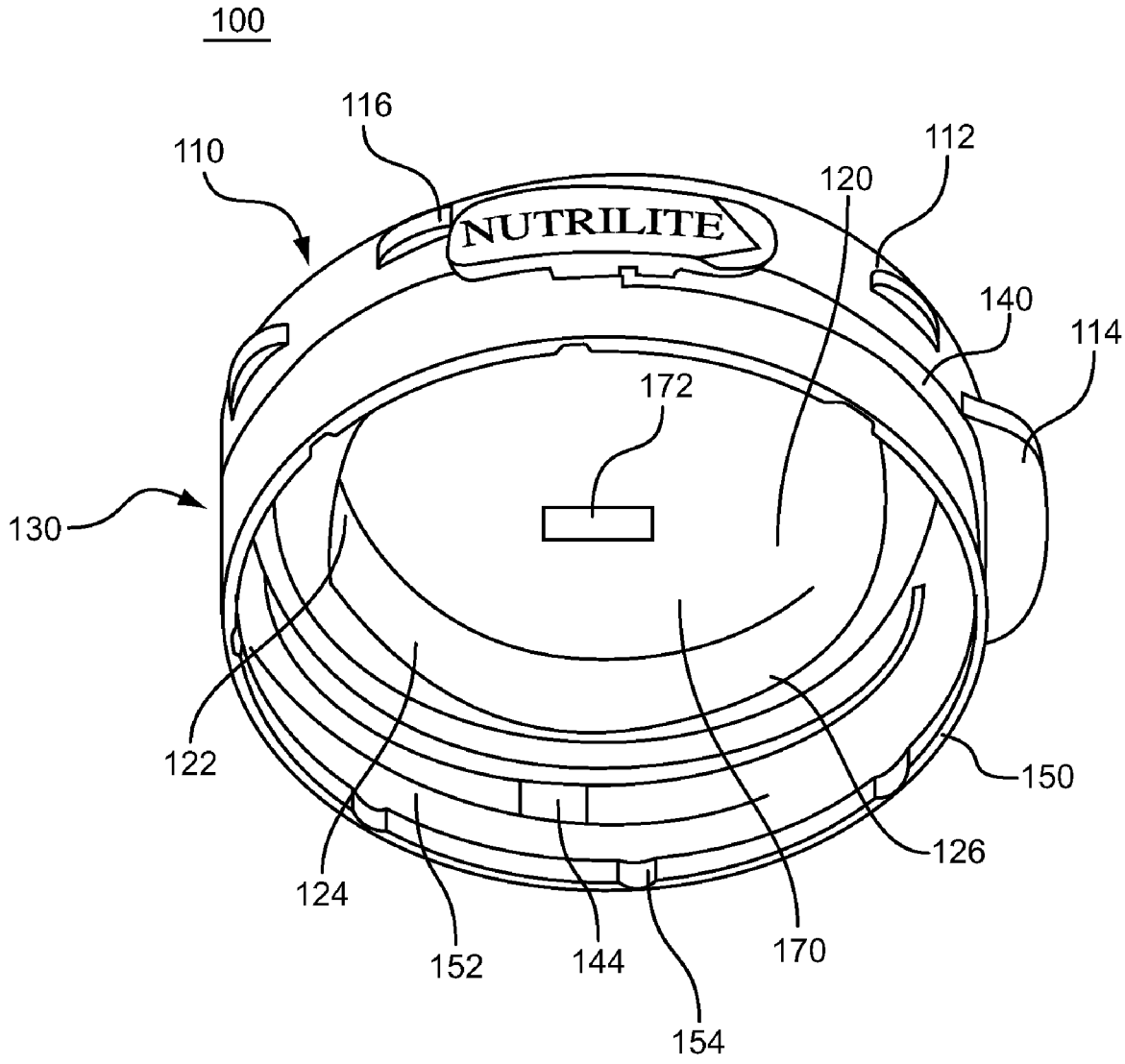
FIG. 4 is a diagram of an angled bottom view of a cap closure assembly including a token.
Figure 5:
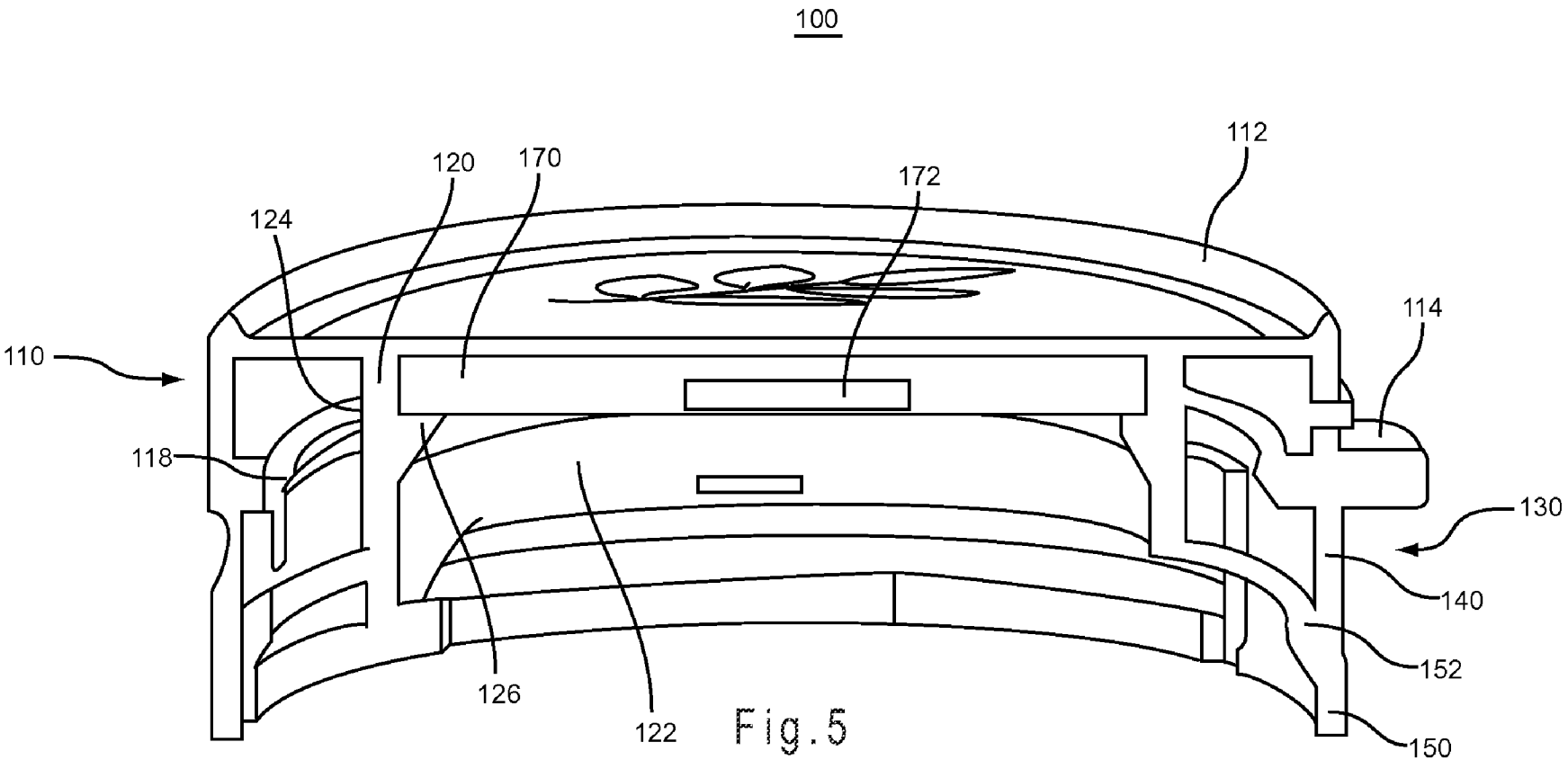
FIG. 5 is a diagram of a cross section a cap closure assembly including a token.

Referring to FIGS. 4 and 5, a cap closure assembly 100 including a token 170 is shown from an angled bottom view and a cross sectional view. The token 170 may be wafer shaped to fit in a cylindrically shaped token engagement portion 126 described above. Additionally, or alternatively, the token may be any shape. It should be apparent to one of ordinary skill in the art that the token engagement portion 126 may also be formed using a variety of shapes so as to secure any type of token 170 to the cap closure assembly 100.

The token 170 may include an RFID tag 172. The RFID tag 172 may store product information about the contents of the container 200. For example, the RFID tag 172 may store information relating to the manufacturer of the product. The RFID tag 172 may also include a product manufacture date that indicates the date on which the product contained therein was created. The RFID tag 172 may also include product expiration information that may indicate a date by which the product should be used. Other product information may also be stored on the RFID tag 172.

As is evident, the embodiments provide a very effective solution for an apparatus for closing a container. The foregoing description and drawings are provided for illustrative purposes only and are not intended to limit the scope of the invention described herein or with regard to the details of its construction and manner of operation. In addition, the dimensions and sizes described herein are not intended to be limiting as they can be altered to fit the needs of a particular container needing a flip-top closure. It will be evident to one skilled in the art that modifications and variations may be made without departing from the spirit and scope of the invention. Changes in form and in the proportion of parts, as well as the substitution of equivalents, are contemplated as circumstances may suggest and render expedience; although specific terms have been employed, they are intended in a generic and descriptive sense only and not for the purpose of limiting the scope of the invention set forth in the following claims.

What is claimed is:

1. A closure assembly for securing the contents of a container, the closure assembly comprising:

an upper closure portion securable to the container; and a lower closure portion attached to the upper closure portion and securable to the container, where the lower closure portion includes a plurality of gaps in the lower closure portion that have a smaller thickness than each other section of the lower closure portion, where the gaps are adapted to indicate tampering with the lower closure portion such that the lower closure portion includes visible damage when an attempt is made to disengage the lower closure portion from the container;

wherein the lower closure portion includes a removable tear away portion above the gaps that partially encircles the lower closure portion and that allows the upper closure portion to be partially disengaged from the container without disengaging the lower closure portion, further wherein the upper closure portion remains engaged with the lower closure portion at a location where the tear away portion does not encircle the lower closure portion.

2. The closure assembly portion of claim 1, where the upper closure portion includes a token compartment section adapted to secure a token to the upper closure portion, the token including an RFID tag.

3. The closure assembly of claim 1, where the upper closure portion includes a sealing section adapted to form a seal between the cap assembly and the container.

4. The closure assembly of claim 1, wherein the upper closure portion remains engaged with the lower closure portion to form a hinge between the upper closure portion and the lower closure portion, and further wherein the removal of the tear away portion allows the upper closure portion to be partially disengaged from the container around the partial encircling from the removable tear away portion.

5. The closure assembly of claim 1, where the tear away portion includes an elongated tab for assisting in the removal of the tear away portion.

6. The closure assembly of claim 1, where the plurality of gaps are disposed at the bottom of the lower closure portion.

7. The closure assembly of claim 1, where upper closure portion includes an upper closure engagement section adapted to engage a first recess in the container and the lower closure portion includes a lower closure engagement section adapted to engage a second recess in the container.

8. The device of claim 1, where the lower closure portion is adapted to abut a lip of the container.

9. A closure assembly for securing the contents of a container, the closure assembly comprising:

an upper closure portion securable to the container; and a lower closure portion attached to the upper closure portion and securable to the container, where the lower closure is adapted to be visibly damaged if disengaged from the container, further where the lower closure portion includes a lower closure engagement section adapted to engage a first recess in the container and the upper closure portion includes an upper closure engagement section adapted to engage a second recess in the container;

where the lower closure portion comprises a removable tear away portion above the gaps that partially encircles the lower closure portion and that allows the upper closure portion to be partially disengaged from the container without disengaging the lower closure portion, further wherein the upper closure portion remains engaged with the lower closure portion at the location where the tear away portion does not encircle the lower closure portion to form a hinge between the upper closure portion and the lower closure portion.

10. The closure assembly of claim 9, where the upper closure portion includes a token compartment section adapted to secure a token to the upper closure portion, the token including an RFID tag.

11. The closure assembly of claim 9, where the upper closure portion includes a sealing section adapted to form a seal between the cap assembly and the container.

12. The closure assembly of claim 9, where a greater force is required to remove the lower closure engagement section from the first recess than a force required to remove the upper closure engagement section from the second recess.

13. The closure assembly of claim 9, where the removal of the tear away portion allows the upper closure portion to be partially disengaged from the container around the partial encircling from the removable tear away portion.

14. The closure assembly of claim 9, where the tear away portion includes an elongated tab for assisting in the removal of the tear away portion.

15. The closure assembly of claim 9, where the lower closure portion includes a removable tear away portion, further where removal of the tear away portion completely separates the upper closure portion from the lower closure portion.

16. The closure assembly of claim 15, where tampering is evidenced when the upper closure engagement is disengaged without utilizing the tear away portion.

17. The closure assembly of claim 14, where the lower closure portion is adapted to abut a lip of the container.

18. A closure assembly for securing the contents of a container comprising:

an upper closure portion securable to the container, the upper closure portion including:

an upper closure engagement section adapted to engage a first recess in the container, and a token compartment section adapted to secure a token to the upper closure portion, the token including an RFID tag a lower closure portion attached to the upper closure portion and securable to the container, the lower closure portion including:

a lower closure engagement section adapted to engage a second recess in the container, where the lower closure engagement section includes a first section having a first cross section and a second section having a second cross section, the second cross section smaller than the first cross section, where the second cross section is adapted to damage if the lower closure section is disengaged from the container, and a tear away portion removably attached to the lower closure engagement section and the upper closure portion, where the upper closure portion may be disengaged from the container tear away portion without disengaging the lower closure portion if the tear away portion is removed.

* * * * *